United States Patent [19]

Taran

[11] 4,087,989

[45] May 9, 1978

[54] BRACELET

[76] Inventor: George D. Taran, 252 Paoa Place, Honolulu, Hi. 96815

[21] Appl. No.: 710,918

[22] Filed: Aug. 2, 1976

[51] Int. Cl.[2] ..... A44C 5/00

[52] U.S. Cl. ..... 63/11; 63/5 R

[58] Field of Search ..... 63/3, 7, 11, 15, 4, 63/DIG. 1, DIG. 2, DIG. 3, 9, 10; D11/4; 24/7, 8, 9

[56] References Cited

U.S. PATENT DOCUMENTS

| | | | |
|---|---|---|---|
| 1,333,284 | 3/1920 | Schreiber | 63/15 |
| 1,933,576 | 11/1933 | Weed | 63/3 |
| 2,180,980 | 11/1939 | Fassnacht et al. | 63/7 |

*Primary Examiner*—Louis G. Mancene
*Assistant Examiner*—Mickey Yu
*Attorney, Agent, or Firm*—William B. Walter

[57] ABSTRACT

A wrist encircling one-piece discontinuous flexible bracelet has a recessed outside surface protected by an upstanding ridge on each edge and a thin flexible decorative cover which fits between the upstanding ridges around the bracelet with the cover attached to the bracelet at spaced locations so that when the bracelet is sprung open to slip it onto the wrist to wear it or remove it from the wrist, the cover is free between attachments to bend away from the bracelet to relieve it and the attachments from the compressive loads on the decorative cover.

1 Claim, 10 Drawing Figures

BRACELET

BACKGROUND OF THE INVENTION

Bracelets worn for adornment of the wearer having a decorative surface between two upstanding edge ridges are shown in U.S. Pat. Nos. 357,326 to Lord, 1,916,821 to Bigney, 2,180,980 to Fassnacht et al and 2,522,852 to Apps. Each of these bracelets has a hinged opening and a catch and therefor the bracelet structure per se is not sprung or bent to allow it to be slipped over the wrist. The light gauge decorative outer surface of these bracelets is commonly soldered or otherwise continuously fastened to the bracelet structure.

The fastening of such a cover to the outside surface of a wrist encircling one-piece discontinuous flexible bracelet is difficult because when the bracelet is sprung open, the outer surface is in compression and must shorten in length placing great strain upon the attachment and tending to buckle the decorative cover. However, this form of bracelet is often desired because it has no joints and thus has a smooth surface throughout its length. Weed in U.S. Pat. No. 1,933,576 showed a C-spring bracelet in which the decorative cover in the form of a filigree metal strip is inserted between two edge channels in a flat ductile metal strap and confined thereby and also by two end stops. The combination is then formed into the C-spring shape. It is assumed that sufficient clearance is allowed on the sides and ends of the cover to allow for the differential movement required upon springing the C-spring bracelet open.

BRIEF SUMMARY OF THE INVENTION

The object of this invention is to secure a thin gauge decorative cover to the outside surface of a wrist encircling one-piece discontinuous springy bracelet in such a manner that the cover will remain on the bracelet through a great number of cycles of opening and closing of the bracelet as it is expanded to slip over the wrist of the wearer.

It is another object of the invention to provide a bracelet structure which will allow the owner to readily change a decorative cover or to replace a decorative cover on the bracelet to match her apparel, or to provide a new clean decorative cover.

This invention is the spaced attachment of a thin flexible decorative cover to the outside surface of a wrist or ankle encircling discontinuous springy bracelet to secure the cover yet allow it to bend when the bracelet is sprung open. The preferred form of attachment is a spot of transfer tape having adhesive on both sides at each end of the decorative cover and one at the midsection of the decorative cover.

DETAILED DESCRIPTION OF THE INVENTION

Figure 1:
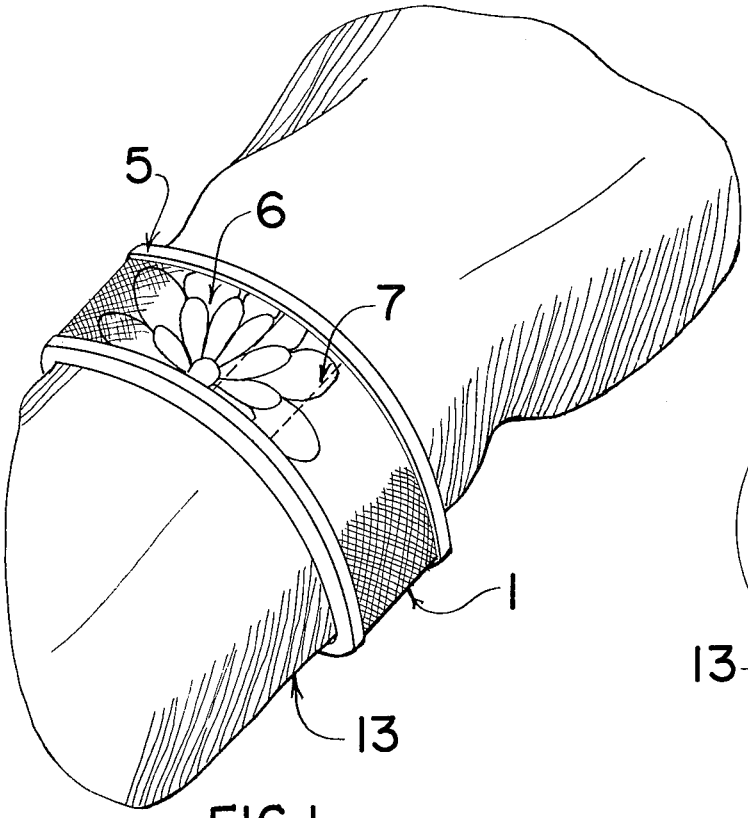
FIG. 1 is a top view of a bracelet according to this invention as worn on a wrist.
Figure 2:
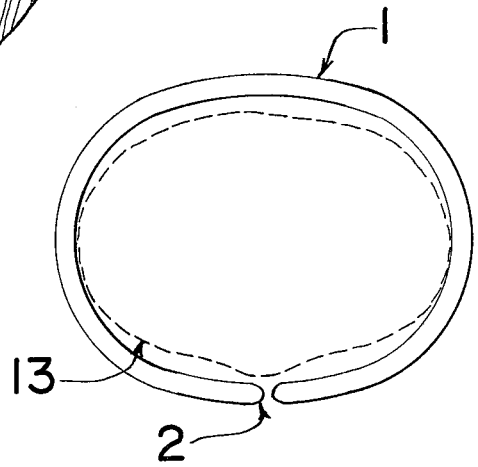
FIG. 2 is a view of the edge of the bracelet of FIG. 1 with the outline of the wrist shown in phantom.
Figure 3:
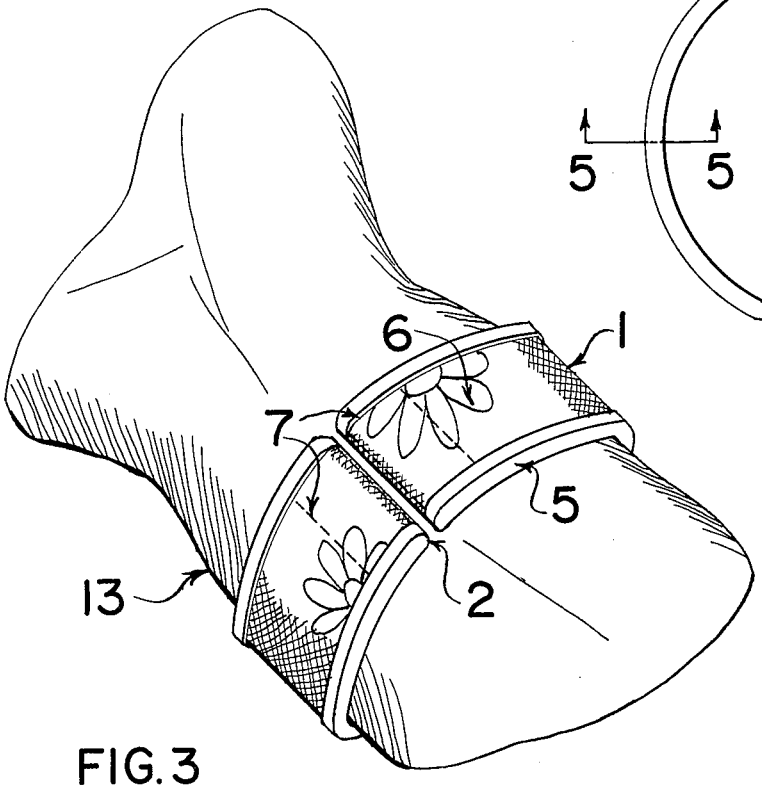
FIG. 3 is a bottom view of the bracelet of FIG. 1.
Figure 4:
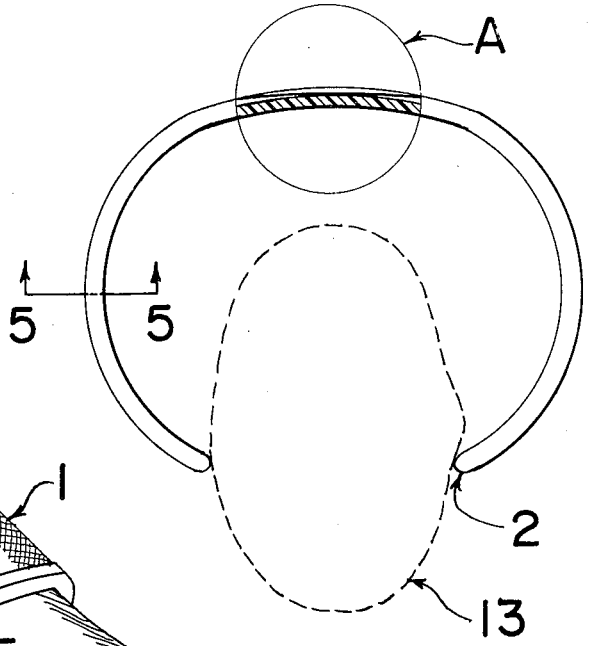
FIG. 4 is a view of the edge of the bracelet of FIG. 1 as it is sprung open to slip over the wearer's wrist with the wrist shown in phantom outline and including a partial section of the bracelet at A.

The bracelet 1 shown in FIGS. 1 through 6 has a generally cylindrical or oval form as shown in FIGS. 2 and 4 with a break or discontinuity at a midpoint 2. The springiness of the bracelet material allows it to be sprung open at this discontinuity 2 to be slipped over the wrist 13 as seen in FIG. 4.

Figure 5:
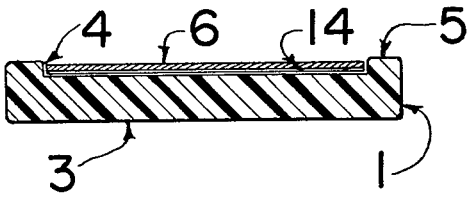
FIG. 5 is a sectional view of the bracelet and decorative cover along the line 5—5 of FIG. 4 and enlarged so as to clarify the construction and action thereof.
Figure 6:
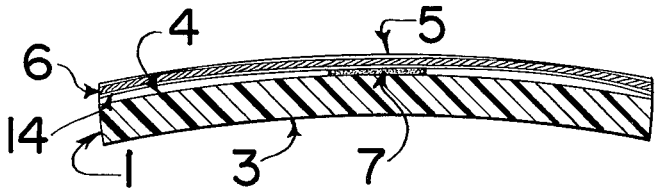
FIG. 6 is an enlarged view of the partial section at A of FIG. 4.

The preferred embodiment of the bracelet 1 has a smooth inner surface 3 and on its outer face a recessed surface 4 between an upstanding ridge 5 at each edge. A thin flexible decorative cover 6 is fitted into the recess 4 and is attached at spaced locations 7 to the recessed surface 4 after being stretched tightly over the recessed surface 4 with the bracelet 1 closed as in FIGS. 1, 2 and 3. As illustrated in FIG. 5, when the bracelet 1 is sprung open, the decorative cover 6 rises off the surface of the bracelet 1 between points of attachment 7. Because the distance between points of attachment 7 of the decorative cover 6 to the bracelet 1 of the average bracelet is about 4 inches (10.2 cm.) as seen at the central point of attachment 7 in FIG. 6, the angle of lift of the decorative cover 6 off of the primary structure of the bracelet 1 due to buckling when the bracelet 1 is sprung open is so slight as to place little if any stress upon the attachment 7. If the decorative cover 6 is a stiff member as for instance a light gauge metal, this slight angle also places very little stress on the decorative cover 6 and thus insufficient stress to result in a permanent deformation or wrinkle.

Figure 7:
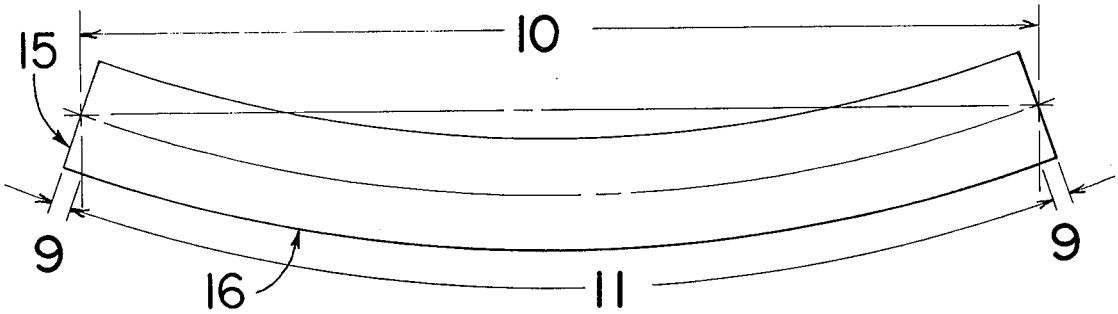
FIG. 7 is a beam diagram illustrating the action of the exterior surface of the bracelet in bending.

As seen in FIG. 7, the bracelet 1 is in effect a beam 15 in bending. The normal condition of this beam 15 is curved as in FIG. 7. When the bracelet 1 is sprung open, the beam 15 is deflected from its normal curved shape towards a straight line configuration. As this occurs, the outer surface 16 of the beam 15 must shorten or buckle by the increments 9 plus the difference between the length of the straight line 10 and the arc 11. If the thin decorative cover is attached to the bracelet 1 in the normal fashion by continuous soldering or glueing, the cover 6 will buckle and thus tear loose from the bracelet 1. I have prevented this situation in which the attachment is broken loose by my spaced attachments 7. I have found that it is sufficient to attach the decorative cover 6 to the primary bracelet structure 1 at a midpoint as well, the cover 6 may be made more secure without subjecting it to undue buckling.

Because of the simple yet effective means of attachment of the decorative cover 6 to the bracelet 1, and the fact that when the bracelet 1 is worn it is either completely closed as in FIG. 2 or almost closed, it is possible to use a very inexpensive and simple manufacturing process in making the basic bracelet structure 1. This process consists of extruding lengths of a thermoplastic with a cross-section as seen in FIG. 5, and then cutting lengths of the extrusion, buffing the ends smooth, and post-forming each length with heat about a mandrel into the form of a bracelet 1. Since the ends of the extrusion as cut to length and formed are abutting or nearly abutting when the bracelet 1 is worn, and the ends of the decorative cover 6 are tightly secured to the bracelet closely adjacent to the ends, preferably with spots of transfer tape having adhesive on both sides, there is no need for a protective ridge across each end.

Figure 8:
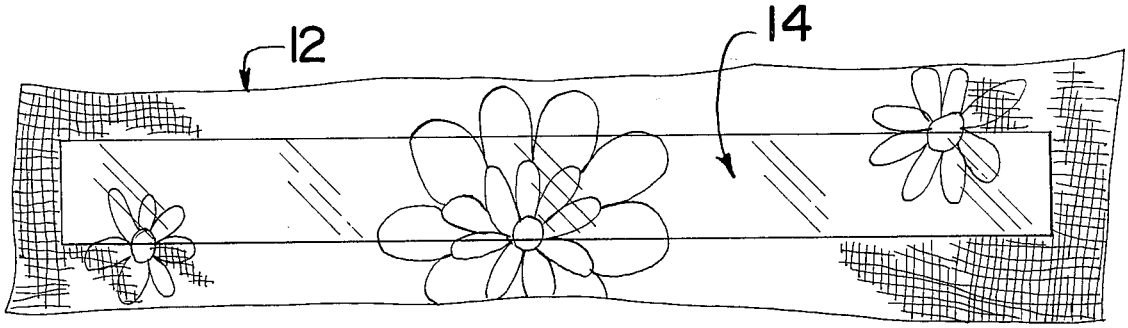
FIG. 8 is a bottom view of a piece of fabric with an adhesive pattern in the form of a length of transparent adhesive tape in place on the fabric.

In the preferred embodiment of my invention, the decorative cover 6 for the bracelet 1 can be readily made by the owner of the bracelet 1 by using a roll of transparent tape which is at least as wide as the recessed portion 4 of the bracelet so as to obtain a self adhering transparent pattern 14 as shown in FIG. 8. The self-adhering transparent pattern 14 is cut to length from the roll and placed on the back side of the fabric 12 which is selected for contrast or match with the clothing to be worn. If the pattern shows through the fabric 12 it is particularly easy to place the pattern 14 at the desired postion on the fabric 12 as shown in FIG. 8. After the self-adhering pattern 14 has been placed on the fabric 12, it is trimmed to length and width to fit between the upstanding ridges 5. This provides a decorative cover 6 of the required length and width and without frayed edges because of the adhesive pattern 14 holding the fibers together.

Figure 9:
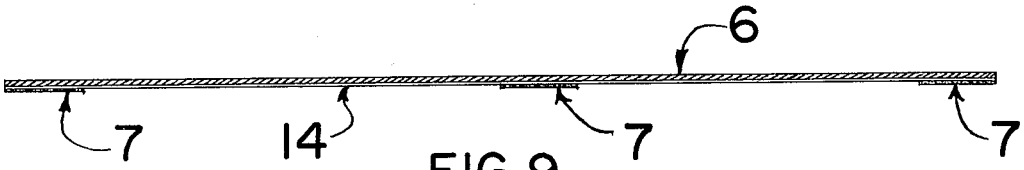
FIG. 9 is a side view of a preferred form of the decorative cover in preparation for installation on the bracelet.
Figure 10:
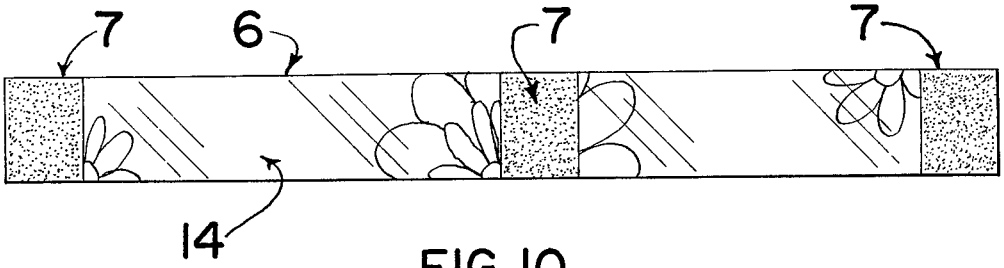
FIG. 10 is a bottom view of the decorative cover of FIG. 9.

Three small pieces 7 of transfer tape having adhesive on both sides are then stuck to the tape side of the decorative cover 6 as seen in FIGS. 9 and 10, one at each end and one at the midsection. Finally, the decorative cover 6 with the three spots of transfer tape 7 is stretched out and fastened to the recessed outer face 4 of the bracelet 1 at the three positions of the transfer tape 7 with the bracelet 1 in the normally closed position.

Any of a variety of thin flexible decorative materials can thus be interchangeably attached to the simple spring type of bracelet in such a way that successive opening and closing of the bracelet will not disturb the fastening because the covering 6 is allowed to flex between fastening points, yet being returned to a stretched-flat position when the bracelet is closed.

Some of the materials well suited for making attractive decorative covers 6 are the following: cloth, leather, vinyl, nylon and light gauge metal.

The upstanding ridges 5 are preferably 0.04 to 0.07 inches (0.1 to 0.18 cm.) above the recessed face 4 to protect the edges of the decorative cover 6 and to provide the required stiffness in the bracelet 1 allowing a thinner gauge of material between ridges 5 for light weight and trim appearance.

Although other forms of attachment such as contact cement and rivets may be used to secure the decorative cover 6 to the recessed surface 4 of the bracelet 1 at spaced locations as shown to allow flexing of the decorative cover 6, the use of transfer tape having adhesive on both sides is preferred so as to allow an easy change in decoration. This also allows the wearer to replace a dirty or soiled decorative cover in a few minutes.

I claim:

1. A bracelet comprising:

a. a resilient discontinuous wrist encircling primary bracelet structure having on its outside surface facing away from the wrist, a recessed central surface with an upstanding ridge on each edge thereof thereby providing a protected surface for a decorative cover;

b. a flexible decorative cover, the length and width of which are approximately the length and width of the recessed outer surface of the primary bracelet structure; and c. attachment means operably securing the flexible cover to the recessed outer surface of the primary bracelet structure at spaced locations along the length of the bracelet comprising a multiple of pieces of transfer tape having adhesive on both faces whereby the decorative cover may be securely attached to the bracelet and the spaces between the means of attachment will allow the decorative cover relief from compressive loads when the primary bracelet structure is sprung open to slip over the wrist.

* * * * *